US006928851B2

(12) United States Patent
Yagawa

(10) Patent No.: US 6,928,851 B2
(45) Date of Patent: Aug. 16, 2005

(54) RIVETING APPARATUS

(75) Inventor: Hiroshi Yagawa, Tokyo (JP)

(73) Assignee: Tyco Electronics AMP K.K., Kanagawa (JP)

( * ) Notice: Subject to any disclaimer, the term of this patent is extended or adjusted under 35 U.S.C. 154(b) by 106 days.

(21) Appl. No.: 10/327,447

(22) Filed: Dec. 20, 2002

(65) Prior Publication Data

US 2003/0121133 A1 Jul. 3, 2003

(30) Foreign Application Priority Data

Dec. 27, 2001 (JP) ..... 2001-396004

(51) Int. Cl.[7] ..... B21J 15/10

(52) U.S. Cl. ..... 72/466.4; 72/466.5; 29/243.54; 29/34 B; 29/524.1

(58) Field of Search ..... 72/466.4, 466.5, 72/466.6; 29/34 B, 524.1, 283, 243.54, 243.53

(56) References Cited

U.S. PATENT DOCUMENTS 1,480,464 A * 1/1924 Pungs ..... 72/466.5
2,354,914 A * 8/1944 Goldstein ..... 72/466.5
2,451,063 A * 10/1948 Brown ..... 72/466.4
3,135,141 A * 6/1964 Aitken ..... 29/34 B
3,635,389 A * 1/1972 Shibata ..... 29/34 B
5,414,921 A * 5/1995 Waldebjer ..... 29/524.1
6,546,618 B1 * 4/2003 Yagawa ..... 29/243.54

FOREIGN PATENT DOCUMENTS

JP 2000-334539 12/2000

* cited by examiner

*Primary Examiner*—David Jones
(74) *Attorney, Agent, or Firm*—Barley Snyder LLC

(57) ABSTRACT

A riveting apparatus has a support die with a support surface. The support surface supports a rivet that extends through a circuit board and an electrical connector. The support surface has a first inclined surface, a second inclined surface, and a depression positioned therebetween. The depression receives a head of the rivet and positionally aligns the rivet with an upper tool unit as the rivet is guided across the first inclined surface toward the second inclined surface. The upper tool unit fastens the rivet to the circuit board.

13 Claims, 3 Drawing Sheets

RIVETING APPARATUS

BACKGROUND OF THE INVENTION

The present invention relates to a rivet fastening device and, more particularly, to a rivet fastening device that positionally aligns rivots that are fastened to secure an electrical connector to a printed circuit board.

DESCRIPTION OF THE PRIOR ART

Japanese Unexamined Patent Publication No. 2000-334539 teaches a riveting apparatus for securing a plurality of electrical connectors to a printed circuit board. The riveting apparatus has an anvil or support die on a lower side and an upper tool unit or pressing die equipped with a crimper for spreading a rivet facing the anvil. A connector holder is positioned between the anvil and the upper tool unit. The connector holder holds the printed circuit board with the electrical connector temporarily fixed thereto. A linking mechanism slightly raises the anvil when the pressing die is lowered to fasten the rivet and secure the electrical connector to the printed circuit board.

The connector holder and the printed circuit board are discoid in shape. The electrical connectors are temporarily fixed on the printed circuit board in a radial pattern by the rivets extending therethrough. The electrical connectors are secured to the printed circuit board by fastening the rivets at predetermined positions while the printed circuit board is rotated. To prevent deformation of the printed circuit board or damage to the riveting apparatus during fastening of the rivets, the rivets of the electrical connectors are positionally aligned with the anvil and the upper tool unit. The electrical connectors are positionally aligned by an extension plate attached to the link mechanism that is received in grooves formed on a periphery of the connector holder. The entrance of the extension plate within the grooves causes the connector holder to stop at predetermined positions in the circumferential direction thereof to positionally align the circuit board, the electrical connector, and the rivets.

Because the connector holder and the link mechanism are both required for positional alignment, the above-described riveting apparatus is a complex structure that requires a high number of parts. As a result, the cost of the riveting apparatus is high. It is therefore desirable to develop an inexpensive riveting apparatus that has a simple positional alignment structure and requires a small number of parts.

SUMMARY OF THE INVENTION

The invention relates to a riveting apparatus having a support die with a support surface for supporting a rivet that extends through a circuit board and an electrical connector. The support surface has a depression that receives a head of the rivet as the rivet slides across the support surface. The depression positionally aligns the rivet with an upper tool unit that fastens the rivet to the circuit board.

DETAILED DESCRIPTION OF THE PREFERRED EMBODIMENT

Figure 1:
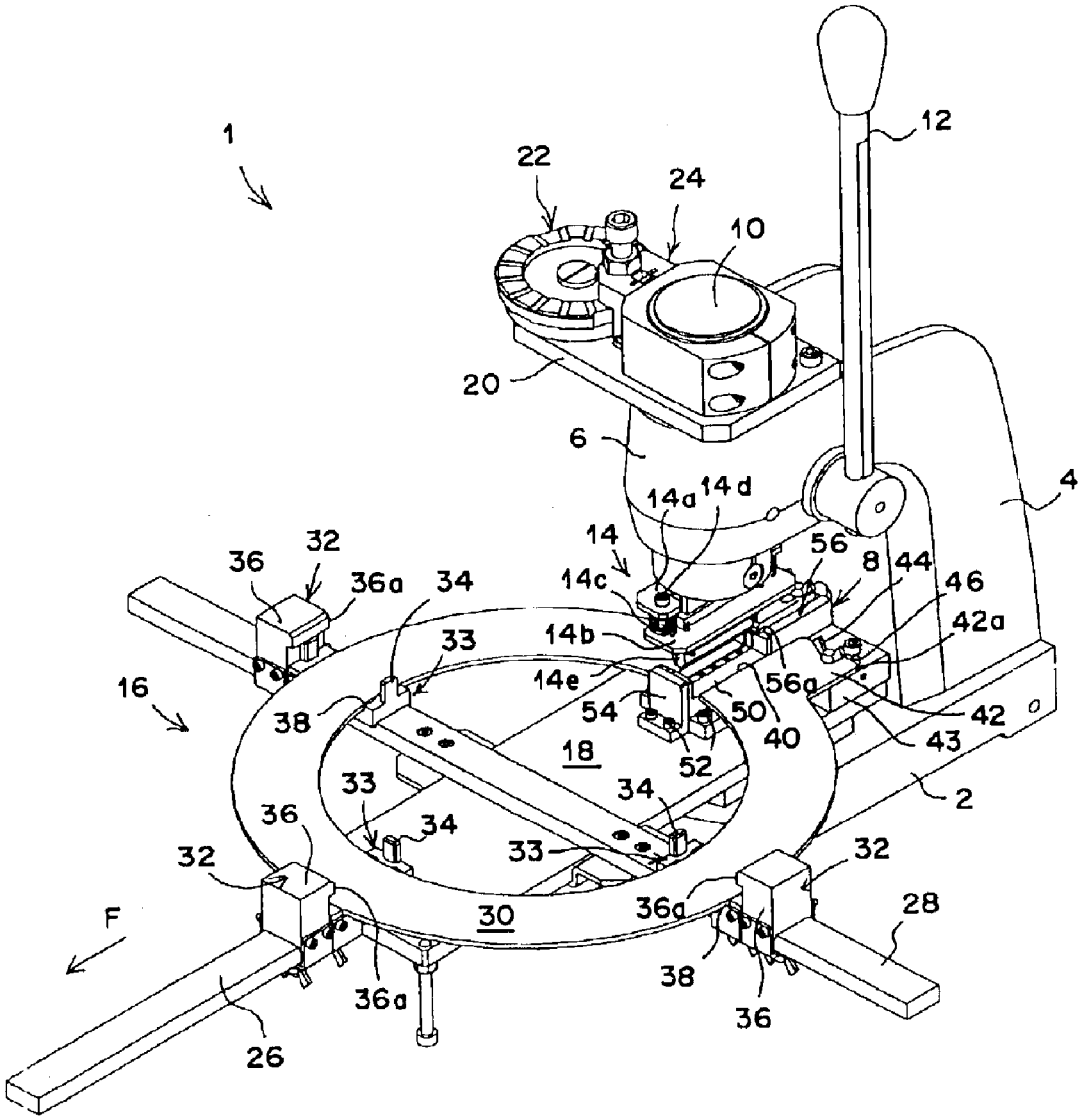
FIG. 1 is a perspective view of a riveting apparatus.

FIG. 1 shows a riveting apparatus 1. The apparatus 1 has a substantially rectangular base 2. A support column 4 protrudes from a rearward edge of the base 2. A ram support portion 6 is integrally formed with the support column 4 and extends forward therefrom. (The forward direction is indicated by arrow F in the Figures and is the forward direction with respect to an operator of the apparatus 1. The direction reverse to the arrow F indicates the rearward direction.) The ram support portion 6 has an aperture (not shown) that extends in a vertical direction. A columnar ram 10 is slidably held within the aperture (not shown). The ram 10 has a rack (not shown). The rack (not shown) engages with pinion gears (not shown) driven by a handle 12 pivotally supported on the ram support portion 6. The ram 10 is structured to move vertically within the ram support portion 6 by rotation of the handle 12.

Figure 3:
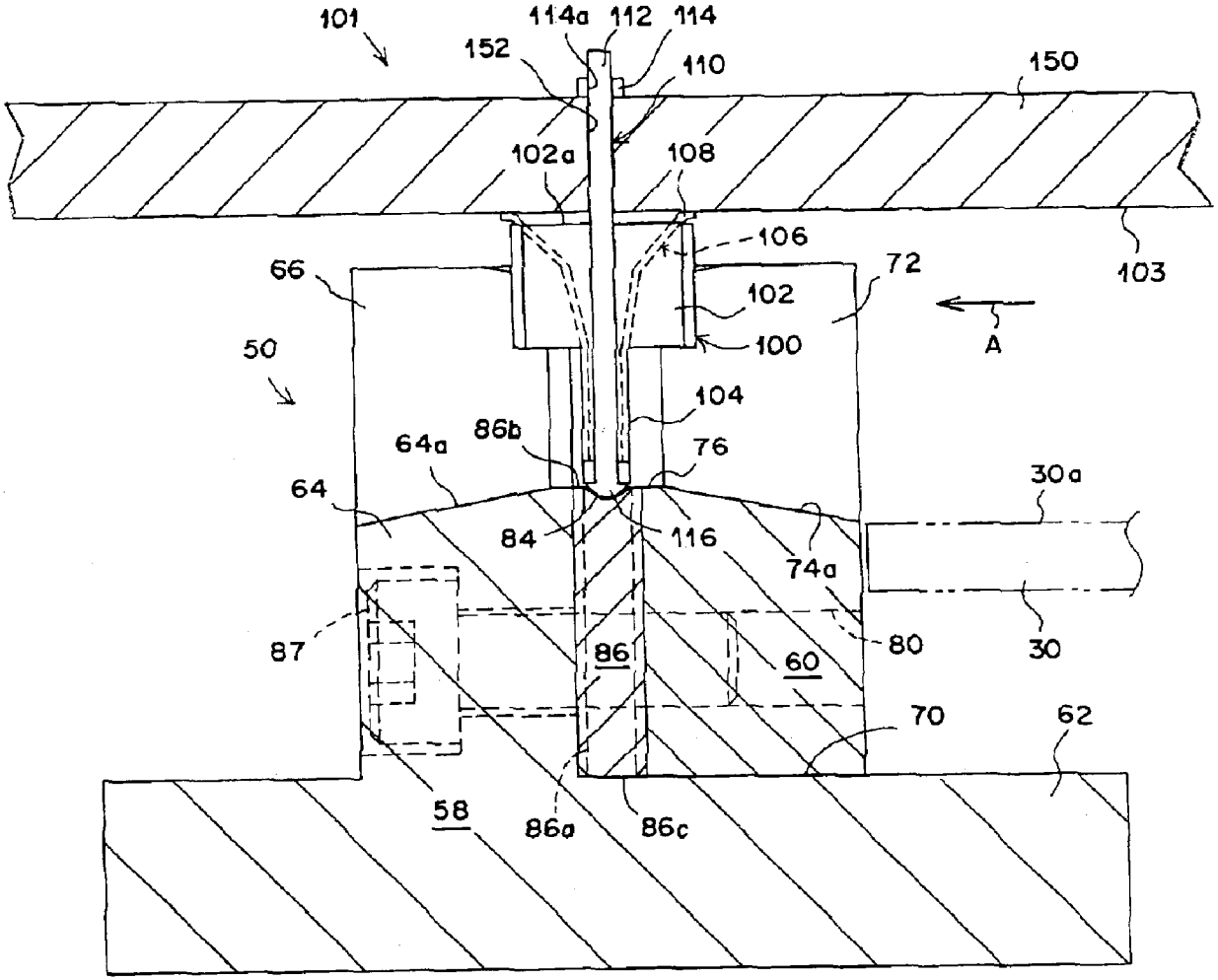
FIG. 3 is a sectional view of the support die and a circuit board assembly showing rivets of an electrical connector temporarily fixed to the circuit board.

An upper tool unit 14 is mounted on a lower portion of the ram 10. The upper tool unit 14 has an upper plate 14*a* and a lower plate 14*b*. The upper plate 14*a* is mounted on the lower portion of the ram 10. The lower plate 14*b* moves about the upper plate 14*a* in a reciprocal motion by a bolt 14*d* that extends through a compression spring 14*c* positioned between the upper plate 14*a* and the lower plate 14*b*. The bolt 14*d* extends through the upper plate 14*a* and is secured to the lower plate 14*b*. A crimper (not shown) for spreading a tip 112 of a rivet 110, as shown in FIG. 3, is mounted on the lower portion of the ram 10. A crimper cover 14*e* is positioned on the lower plate 14*b* to guide the crimper (not shown).

A horizontally extending plate 20 is provided at an upper edge of the ram support portion 6. A bottom dead point adjustment dial 22 is mounted at an outer edge of the plate 20. A bottom dead point determining member 24 for determining the bottom dead point of the ram 10, that is, the lowermost fastening position of the ram 10, is provided at an upper portion of the ram 10. The bottom dead point determining member 24 co-operates with the bottom dead point adjustment dial 22. Because the bottom dead point adjustment dial 22 and bottom dead point determining member 24 have similar features and similar functions to those disclosed in the prior art, detailed descriptions thereof have been omitted.

A circuit board support portion 16 is positioned toward a front of the apparatus 1 and above the base 2. The circuit board support portion 16 has a base body 18. A rearward edge of the base body 18 is mounted on the base 2. A first support rod 26 extends forward from the base body 18. A second support rod 28 extends horizontally outward from the base body 18 and perpendicular to the support rod 26.

Support blocks 33 for receiving an annular plate 30 are mounted on the first and second support rods 26, 28. Grooves 38 are formed in each of the support blocks 33 for receiving the annular plate 30. Support protrusions 34 that support the circuit board 150 are formed on interior sides of each of the support blocks 33. Positioning blocks 32 with positioning protrusions 36 for positioning the circuit board 150 are mounted on the support rods 28 adjacent to the support blocks 33 on the exterior sides thereof. Positioning surfaces 36*a* are formed on the upper edges of the positioning protrusions 36. The positioning surfaces 36 face toward the support protrusions 34. The circuit board 150 is supported by the support protrusions 34 while being positioned by the positioning surfaces 36*a* so that the positioning surfaces 36 and a front edge 56*a* of a block 56 restricts a positional shift in the radial direction of the circuit board 150. The support blocks 33 and the positioning blocks 32 may be separate members formed from a resin or integrally formed from metal.

The annular plate 30 is positioned on a top surface of the first and second support rods 26, 28. The annular plate 30 is formed from a metal such as aluminum, and is generally formed in a ring-like shape. The annular plate 30 has a space 40 for receiving a lower tool unit 8 and a pair of flanges 42 that rest on blocks 43 provided on the base body 18. Pins 46 for preventing rearward movement of the flanges 42 are mounted adjacent to rear edges 42*a* of the flanges 42. Cut-outs (not shown) for receiving butterfly screws are formed in the rear edges 42*a* to secure the flanges 42 to the blocks 43.

The lower tool unit 8 is mounted on the rearward edge of the base body 18 at a position corresponding to the upper tool unit 14. The lower tool unit 8 has an anvil or a support die 50 placed in the space 40 of the annular plate 30. The support die 50 is fixed to the base body 18 by screws 52. A bracket 54 supports a connector mounting surface 103, as shown in FIG. 3, of the circuit board 150 and is fixed to the base body 8 by screws 52. A block 56 prevents the circuit board 150 from moving rearward with a front edge 56*a* and is fixed to the base body 8 by screws 52.

Figure 2:
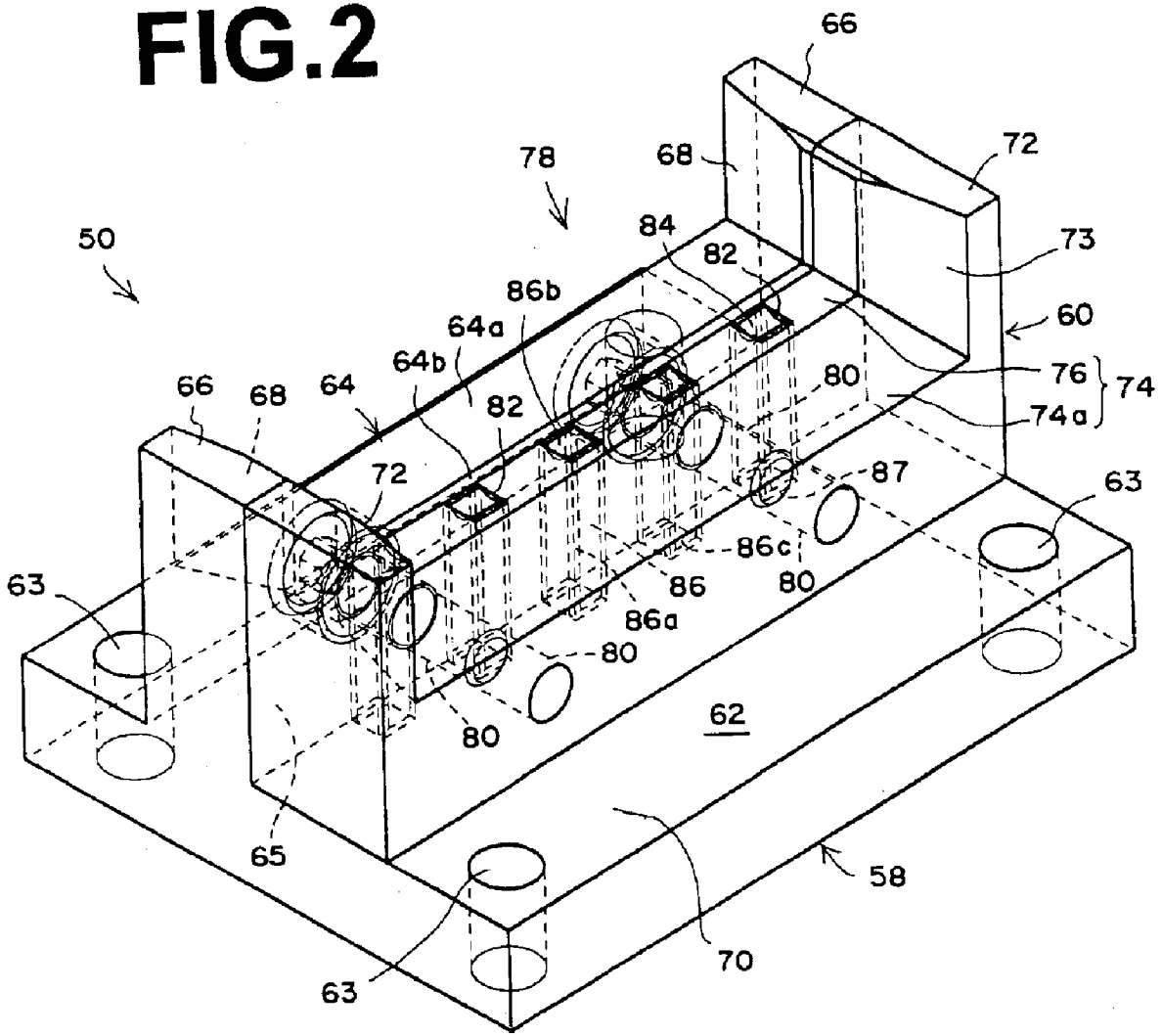
FIG. 2 is a perspective view of a support die of the riveting apparatus.

As shown in FIG. 2, the support die 50 comprises a main block 58 and a sub-block 60. The main block 58 has a rectangular base 62 and a protrusion 64 integrally formed with the base 62 at a position shifted from the center thereof, extending from the front to the rear. Screw receiving apertures 63 are provided at corners of the base 62. Upwardly extending first guide portions 66 are formed at the front and rear edges of the protrusion 64. First tapered portions 68 that open toward exterior sides of the first guide portions 66 are formed on each of the first guide portions 66. An upper portion of the protrusion 64 is formed as a first inclined surface 64*a* that inclines downward toward the exterior side. A first narrow flat surface 64*b* extends in a front to rear direction along an edge of the sub-block 60.

The sub-block 60 is positioned adjacent to the protrusion 64 and on a surface 70 of the base 62. Second guide portions 72 having a similar height as the first guide portions 66 are positionally aligned with the first guide portions 66. Each of the second guide portions 72 have second tapered portions 73 opening toward an exterior side for guiding an electrical connector 100. A peak 74 is formed between the second guide portions 72. The peak 74 has a narrow second flat surface 76 of substantially the same height as the first flat surface 64*b*. A second inclined surface 74*a* inclines downward from the second flat surface 76 toward an upstream side of a conveyance motion of the circuit board 150 (the right side of FIG. 2). The second inclined surface 74*a* and the first inclined surface 64*a* have lengths equal to a length of the electrical connector 100 with respect to a conveyance direction. The main block 58 and the sub-block 60 co-operate to construct a groove 78 for guiding the electrical connector 100. The groove 78 is formed by the first and second inclined surface 64*a*, 74*1*, the first and second flat surfaces 64*b*, 76, and the first and second guide portions 66, 72. The second flat surface 76 and the second inclined surface 74*a* are collectively referred to as a support surface, because a head 116 of the rivet 110 moves over the second inclined surface 74*a* and the second flat surface 76 while in contact therewith.

Cut-outs 82, which correspond to the rivets 110 of the electrical connector 100, are formed in the second flat surface 76 of the sub-block 60 and extend to the lower edge thereof. The cut-outs 82 co-operate with a side surface 65 of the main block 58 to form substantially rectangular holes. As best shown in FIG. 3, rectangular columns 86 that have substantially U-shaped recesses that form the depressions 84 are received in the rectangular holes. Bevels 86*a* are formed from upper surfaces 86*b* to lower surfaces 86*c* of the rectangular columns 86 at corners thereof to facilitate insertion into the rectangular holes. The lower surfaces 86*c* of the rectangular columns are supported by the surface 70 of the main block 58. Horizontally extending bolt apertures 80 that communicate with each other are formed through the main block 58 and the sub-block 60. A bolt 87 is inserted through the bolt aperture 80 to secure the main block 58 and the sub-block 60 to each other.

The electrical connector 100 discussed herein is similar to the electrical connector described in Japanese Unexamined Patent Publication 2000-334539. As shown in FIG. 3, the electrical connector 100 has a wide base 102 and an engagement portion 104. A plurality of terminals 106 having tines 108 are arranged on the electrical connector 100 and extend from the base 102 to the engagement portion 104. The tines 108 protrude from a surface of the base 102.

The electrical connector 100 is surface mounted to an underside of the circuit board 150 to form a circuit board assembly 101. The electrical connector 100 is secured to the circuit board 150 by rivets 110, which penetrate through the electrical connector 100 and into the circuit board 150. The rivets 110 penetrate from the engagement portion 104 of the electrical connector 100, perpendicularly through a bottom surface 102*a* of the base 102, and further through a mounting aperture 152 of the circuit board 150. The electrical connector 100 having the rivet 110 penetrating therethrough is temporarily fixed by the circuit board 150 so that it does not fall therefrom. The mounting aperture 152 is of a diameter such that the rivet 110 is press-fit therein.

The positional alignment of the rivets 110 for fastening the electrical connector 100 to the circuit board 150 will now be described in greater detail with reference to FIGS. 1–3. An operator holds the circuit board 150 by hand and rotates the circuit board 150 until the connector mounting surface 103 of the circuit board 150 is supported by the support blocks 33 and the bracket 54 shown in FIG. 1. As shown in FIG. 3, the circuit board assembly 101 is conveyed in the direction of arrow A from an upstream side so that the electrical connector assembly 101 is conveyed between the upper and lower tool units 14, 8. As the electrical connector 100 moves toward the second flat surface 76, heads 116 of the rivets 110 move in a sliding manner on the second inclined surface 74*a* in a state in which the heads 116 bear the weight of the circuit board 150 under manual power. At this time, the circuit board 150 moves upward along the second inclined surface 74*a* so it floats slightly above the bracket 54. The heights of the support protrusions 34 are set to enable movement in this manner.

The heads 116 of the rivets 110 are received in the depressions 84 of the rectangular columns 86 formed in the second flat surface 76. The heads 116 of the rivets 110 are at a position slightly above the surface 30*a* of the annular plate 30 and lower than the flat surface 76 of the sub-block 60. When the heads 116 become seated within the depressions 84, a clear sensation of positioning is transmitted to the hand of the operator through a click. The fastening position is set to a desired height by rotating the bottom dead point adjustment dial 22. The upper tool unit 14 descends to fasten the rivets 110, by operation of the handle 12. During the fastening operation, the crimper cover 14*e* abuts the circuit board 150 in the vicinity of the rivet 110. The crimper then descends to spread the tip 112 of the rivet 110 to secure the electrical connector 100 to the circuit board 150. As shown in FIG. 3, a metal plate 114 having apertures 114*a* that receive the rivets 110 may also be provided on the circuit board 150. The metal plate 114 protects the circuit board and during the fastening operations, the tips 112 of the rivets 110 may be crushed on the metal plate 114. When the rivets 110 are fastened, the tines 108 of the terminals 106 are pressed against conductive traces (not shown) on the circuit board 150 to establish electrical connections between the terminals 106 and the circuit board 150. During fastening of the rivets 110, the circuit board 150 moves slightly downward due to deformation of the heads 116 of the rivets 110 and the elasticity of the tines 108 of the terminals 106. The circuit board 150 absorbs this movement, because the circuit board 150 floats slightly above the bracket 54. Accordingly, deformation of the circuit board 150 is prevented.

After the fastening operation, the circuit board 150 is conveyed further in the direction of arrow A, and another electrical connector (not shown) is received between the upper and lower tool units 14, 8 for fastening rivets 110 thereto. A single electrical connector may be fastened to the circuit board 150, or a plurality of electrical connectors may be fastened thereto. When a plurality of electrical connectors 100 are to be fastened to the circuit board 150, if the rivets 110 of an electrical connector 100 not yet secured to the circuit board 150 shift due to mechanical shock of the fastening operation, the heads 116 of the unfastened rivets 110 abut the annular plate 30 and are supported thereby so that the rivets 110 and the electrical connector 100 are prevented from disengaging from the circuit board 150.

Positive positional alignment of the rivet 110 is enabled by the co-operative relationship between the anvil 50 and the rivet 110, without employing a complex mechanism. As a result, the apparatus 1 has a small number of parts, is of a simple structure, and is inexpensive. In addition, the rivets 110 are directly positioned in the depressions 84 of the anvil 50 for high positional accuracy. Therefore, in the case that the support surface comprises an incline plane that inclines upward from the upstream side of the direction of travel of the circuit board assembly 101 to the downstream side thereof, even if there are minor fluctuations in the vertical position of the circuit board 150 to which the electrical connector 100 is mounted, positive positional alignment is enabled. The apparatus 1 may also be used for correcting the positioning of an electrical connector 100 already mounted on the circuit board 150.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents. For example, the upper portions of the main block 58 and the sub-block 60 need not be inclined surfaces, but may be flat surfaces. In this case, to perform positive positioning, it is necessary that the heads 116 of the rivets 110 slide along the flat surface in a state in which the heads 116 are urged downward by the weight of the circuit board assembly 101. By this downward urging, the heads 116 of the rivets 110 will be seated within the depressions 84 with a click sensation.

I claim:

1. A riveting apparatus, comprising:

a support die having a support surface that supports a rivet that extends through a circuit board and an electrical connector, the support surface having a first inclined surface, a second inclined surface, and a depression positioned therebetween, the depression receives a head of the rivet and positionally aligns the rivet with an upper tool unit that fastens the rivet to the circuit board as the rivet is guided across the first inclined surface toward the second inclined surface, and the support die includes a main block and a sub-block, the main block includes the second inclined surface and a base that supports the sub-block, the sub-block includes the first inclined surface and the depression.

2. The riveting apparatus of claim 1, wherein the support surface has a substantially flat portion adjacent to the depression.

3. The riveting apparatus of claim 1, wherein the first and second inclined surfaces have a length substantially the same as the electrical connector.

4. The riveting apparatus of claim 1, wherein the second inclined surface is formed so that the circuit board absorbs a force of the upper tool unit caused by fastening the rivet to the circuit board.

5. The riveting apparatus of claim 1, wherein the support die causes a sensation of correct positioning to be transmitted to an operator when the head of the rivet is received in the depression.

6. The riveting apparatus of claim 1, wherein the first and second inclined surfaces converge to form a peak and the depression is formed at the peak.

7. The riveting apparatus of claim 1, wherein the support die has a cut-out that receives a column having a substantially U-shaped recess that forms the depression.

8. A riveting apparatus, comprising:

a support die having a support surface that supports a rivet that extends through a circuit board and an electrical connector, the support surface having a first inclined surface, a second inclined surface, and a depression positioned therebetween, the depression receives a head of the rivet and positionally aligns the rivet with an upper tool unit that fastens the rivet to the circuit board as the rivet is guided across the first inclined surface toward the second inclined surface, and the support die has a cut-out that receives a column having a substantially U-shaped recess that forms the depression.

9. The riveting apparatus of claim 8, wherein the support surface has a substantially flat portion adjacent to the depression.

10. The riveting apparatus of claim 8, wherein the first and second inclined surfaces have a length substantially the same as the electrical connector.

11. The riveting apparatus of claim 8, wherein the second inclined surface is formed so that the circuit board absorbs a force of the upper tool unit caused by fastening the rivet to the circuit board.

12. The riveting apparatus of claim 8, wherein the support die causes a sensation of correct positioning to be transmitted to an operator when the head of the rivet is received in the depression.

13. The riveting apparatus of claim 8, wherein the first and second inclined surfaces converge to form a peak and the depression is formed at the peak.

* * * * *